United States Patent [19]

Juttelstad et al.

[11] 4,193,550

[45] Mar. 18, 1980

[54] CHEMICAL INJECTION HEAD

[75] Inventors: David L. Juttelstad, Gayville; Philip Johnson, Vermillion, both of S. Dak.

[73] Assignee: Dura Corporation, Southfield, Mich.

[21] Appl. No.: 837,182

[22] Filed: Sep. 28, 1977

[51] Int. Cl.[2] ..... B05B 7/30

[52] U.S. Cl. ..... 239/314; 51/439; 239/318; 239/597

[58] Field of Search ..... 239/314, 310, 318, 592, 239/597, 433; 51/439

[56] References Cited

U.S. PATENT DOCUMENTS

| | | | |
|---|---|---|---|
| 2,176,577 | 10/1939 | Tirrell | 51/321 |
| 2,200,587 | 5/1940 | Tirrell | 51/321 |
| 2,543,294 | 2/1951 | McCabe | 239/318 |
| 2,785,012 | 3/1957 | Frewin | 239/318 |
| 3,763,888 | 10/1973 | Duecker | 239/318 |
| 3,881,656 | 5/1975 | Markfelt et al. | 239/433 |

*Primary Examiner*—John J. Love
*Assistant Examiner*—Michael J. Forman
*Attorney, Agent, or Firm*—Hill, Van Santen, Steadman, Chiara & Simpson

[57] ABSTRACT

A nozzle body of a molded spray head forms a path for a highly pressurized carrier fluid. The fluid path includes a rectangular-section, diverging outlet and a spray nozzle spaced upstream therefrom in a suction chamber for directing the carrier fluid in a spray pattern spaced inwardly of and parallel to the walls of the diverging outlet. A chemical product is selectively passed into the suction chamber for entrainment about the carrier fluid. Avoiding impingement of the carrier fluid spray upon the walls of the nozzle outlet helps to maintain the 600–1000 psi pressure of the carrier fluid flow throughout the nozzle body for increased impact pressure upon surfaces to be sprayed.

1 Claim, 4 Drawing Figures

CHEMICAL INJECTION HEAD

BACKGROUND OF THE INVENTION

1. Field of the Invention

The present invention relates to pressure spray washing and cleaning heads.

2. The Prior Art

A variety of chemical application nozzles are known in the art having variable-section outlet nozzles and internal sprays directed into such nozzles. Typical of such prior art are the expired U.S. Pat. Nos. 2,176,577 and 2,200,587. In each of these patents a first fluid stream flows along an axis of varying cross-sectional size and shape including mixing regions wherein a venturi effect is created and a second granular or fluid product is picked up and carried in the stream. In both of these prior patents, however, diverging sprays are formed and are directed into outlet nozzles which converge along at least part of their lengths. The converging sections in the outlet nozzles create eddies in the flow, apparently to mix the fluid carrier and chemical agent in eddies and other turbulent flows. Such turbulence decreases the impact pressure of the carrier fluid, decreasing the power of the spray outside the nozzle.

SUMMARY OF THE INVENTION

A chemical injection spray head using a high pressure liquid stream forms the stream into a free diverging spray within the head. The spray passes through a diverging outlet nozzle without impinging on the walls thereof. A chemical agent is adduced selectively about the spray upstream of the outlet nozzle, the agent mixing only with the sides and edges of the spray and being entrained therewith for ejection through the outlet nozzle in a combined spray of improved impact force.

THE DRAWINGS

THE PREFERRED EMBODIMENTS

Figure 1:
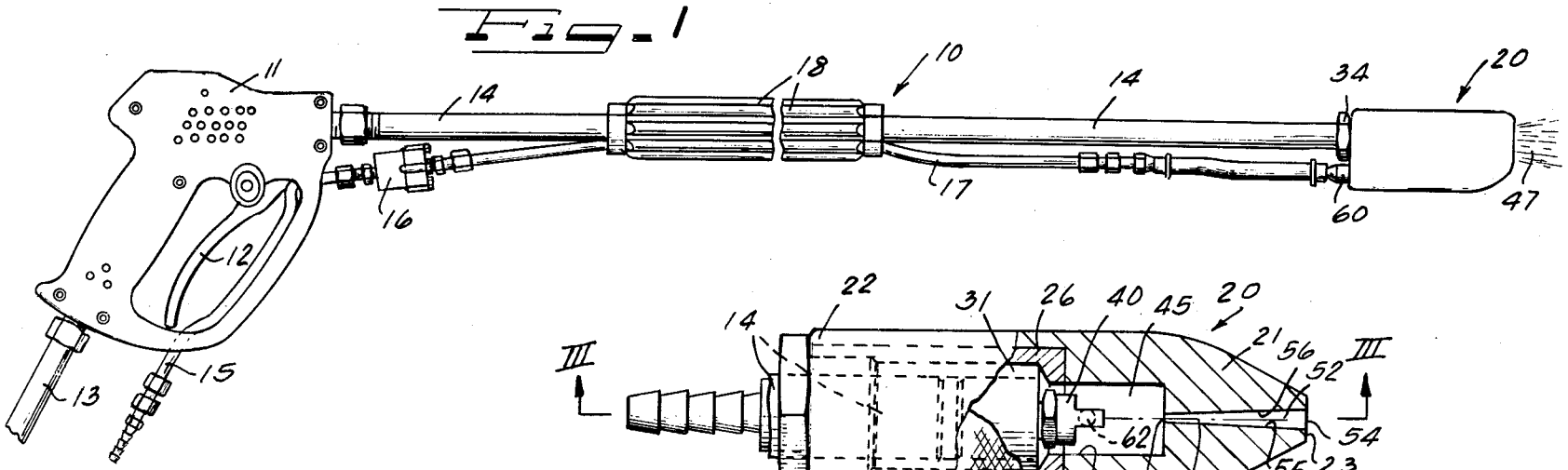
FIG. 1 is a side elevational view of a spray gun and head incorporating the present invention.

A spray gun assembly 10 comprises a handle unit 11 having a trigger 12 which is manually operated to control the flow of a liquid such as water from a supply line 13 into an output line 14. A supply of chemical product from a supply conduit 15 is controlled by a flow control valve 16, from which the chemical passes into a chemical line 17 communicating to a spray head 20 which in turn is carried on and communicates to a downstream end of the liquid line 14. An elongate handle 18 is mounted about the liquid line 14 and the chemical line 17 to facilitate control and positioning of the gun assembly 10. Any other convenient handle 11 and liquid and chemical supply arrangement may be employed, depending on the application, as is well known to those skilled in the art.

In accordance with the present invention, the spray head 20 comprises a molded body 21 having a rear, carrier fluid inlet end 22 and a front, spray outlet end 23.

Figure 2:
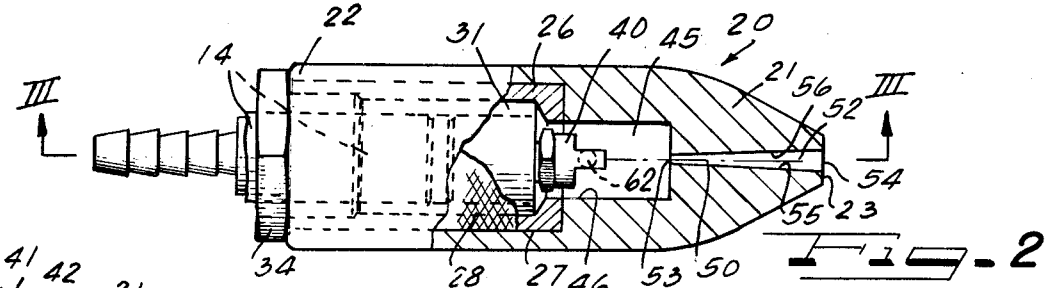
FIG. 2 is a top elevational view, partly broken away and in longitudinal section, of the spray head of the invention.
Figure 3:
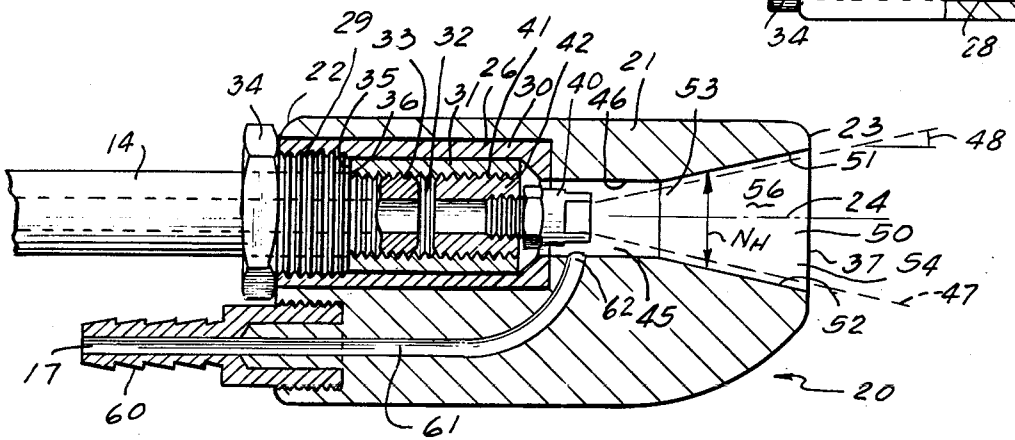
FIG. 3 is a side sectional view, taken on line III—III of FIG. 2.
Figure 4:
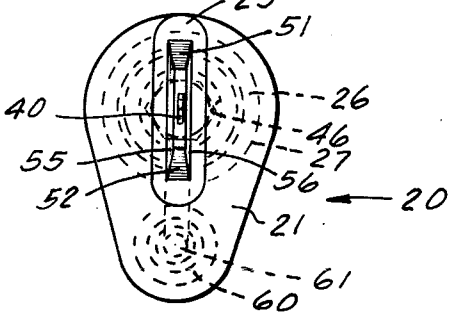
FIG. 4 is a front elevational view of the spray head of the present invention.

An axial flow passage is formed between the ends 22, 23 along an axis 24, as in FIGS. 2 and 3. The rear end 22 of the body 21 is formed with a cylindrical aperture along the axis 24, and a brass insert 26 is fitted thereinto. An exterior surface 27 of the insert 26 is knurled, as at 28. A rear internal portion 29 of the brass insert 26 is threaded, while a forward internal portion 30 is left with a cylindrical finish. A coupling 31, preferably having an external brass bushing, is received within the forward position 30 of the insert 26, and carries a threaded internal portion 32 therein. The liquid line 14 is threadably connected into the rear center 33 of the coupling 31. A jam nut 34 threadably connects to the brass insert 26, engaging the threads 29 thereof, and a forward edge 35 thereof engages snugly against a rear end 36 of the coupling 31.

A spray nozzle 40 is carried on a forward end 41 of the coupling 31, via an intermediate coupling 42 as convenient. In the installed position, the spray nozzle 40 is situated within a suction chamber 45 of the fluid passage having a cylindrical wall 46 about the axis 24. The spray nozzle 40 accepts a flow of fluid from within the water line 14 and the interior of the coupling 26 and, by its interior surfaces, develops a thin, flat, diverging spray pattern 47. The divergence angle in the vertical plane of FIG. 3 is about 15°, as at 48.

Downstream of the suction chamber 45 is a diverging outlet nozzle 50, having an increasing vertical height $N_H$ formed by top and bottom walls 51, 52. That is, an inlet end 53 of the outlet nozzle 50 is smaller in vertical dimension $N_H$ than the dimension at the outlet end 54. Similarly, the side walls 55, 56 preferably diverge in the downstream direction, although they need not.

In acordance with the principles of the invention, the walls of the outlet nozzle 50 are situated in relation to the spray nozzle 40 so that thin upper and lower edges and broader sides of the spray pattern 47 are spaced from each of the nozzle outlet walls 51, 52, 55, 56. The edges and sides of the pattern 47 will generally be defined by small water droplets created by friction between the water stream and the interior surfaces of the spray nozzle 40.

Further in accordance with the present invention, the chemical agent line 17 is connected through a fitting 60 communicating into the rear end 22 of the nozzle body 21, to a chemical agent conduit 61 and into the suction chamber 45 through the wall 46 thereof at an inlet port 62. The inlet port 62 is spaced upstream of the outlet of the spray nozzle 40, so that the entire space or volume of the suction chamber 45 may be filled with chemical agent from the line 17.

In operation, the liquid supply line 13 upstream from the gun 10 is connected to a source of high pressure fluid such as water, while the chemical supply line 15 is connected to a source of flowable or liquid cleaning, scouring, or dissolving agent which is desired to be mixed with the liquid carrier in a directed spray. When the trigger 12 of the handle 10 of the gun assembly is depressed, liquid flows through the supply line 13 in the liquid line 14, through the spray nozzle 20 along the axis 24. A tall but thin spray will thereby be produced from the outlet end 54 of the spray nozzle 50 in the forward end 23 of the nozzle body 21. Such pure liquid spray may be used for initial wetting of a surface, for initial cleaning of impurities, and for rinsing.

When the flow control valve 16 is opened, chemical agent from the line 15 is allowed to pass into and through the chemical line 17 and through the inlet port 62 into the suction chamber 45. Reduced static pressure created within the suction chamber 45 by the rush of high pressure fluid from the spray nozzle 40 draws the chemical agent through the lines to fill the chamber 45. With 600 to 1000 psi pressure in the liquid line 14, a suction in the chamber 45 of from 6 to 12 feet of water will be created. Such suction, while substantially less than that created by venturi-type spray nozzles, shows that substantially more of the pressure in the water line 14 is preserved in the outlet spray 47. The chemical agent mixes with the turbulent exterior portions of the spray 47 in the chamber 45 and the outlet nozzle 50 by a process of entrainment of the chemical with the turbulent surfaces of the spray 47.

The spray of combined chemical and liquid carrier will continue until the supply of chemical is cut off at the valve 16 or the flow of water is cut off as at the trigger 12. The chemical will thereupon stop flowing from the inlet port 62 and from the chemical line 17. If the water flow continues, the suction chamber 45 will clear itself of such chemical as has already entered, possibly refilling with air by reverse flow through the outlet nozzle 50 about the spray 47. Thus the spray 47 is quickly returned from a mixed spray to a pure liquid spray for rinsing a surface free from the chemical agent.

Although various minor modifications may be suggested by those versed in the art, it should be understood that we wish to embody within the scope of the patent warranted hereon all variations as come within the scope of our contribution to the art.

We claim as our invention:

1. A high-pressure liquid injection head for mixing and jetting a stream of liquid carrier and a potentially corrosive liquid chemical as a cleaning compound, said head comprising:

a nozzle body having an input for a relatively inert pressurized liquid carrier and having formed therein:

an outlet channel having rectangular cross-section and having walls diverging in a downstream flow direction and terminating in an outlet through which the mixed compound is discharged in the form of a jet stream, a cylindrical suction chamber having an upstream termination communicating with said carrier input and having a downstream termination communicating directly with a smallest upstream end of said outlet channel and having a cross-sectional area substantially greater than the area of said aperture, a liquid chemical inlet passage in communication with the suction chamber at a first point upstream of said aperture with a liquid chemical source;

a nozzle removably mounted in said nozzle body and connected to said carrier input and extending a distance into said suction chamber in axial alignment with said aperture and terminating in said chamber downstream of said first point said nozzle having diverging interior walls forming a channel diverging at a same angle as said outlet channel, and said nozzle terminating in said chamber a distance from said aperture such that a jet stream emitted from said spray nozzle directed at said aperture has a cross-section smaller than said aperture when said stream reaches the aperture;

said pressurized jet stream through said suction chamber creating a pressure drop therein to draw said liquid chemical from said chemical source into said suction chamber at said first point for mixing therein with said carrier jet stream, the resulting carrier-chemical mixture being expelled through said outlet channel in the form of a diverging jet stream having substantially no contact with said channel walls, thereby to safeguard the operating components of the spray head against corrosion and to apply the carrier-chemical mixture to an object to be cleaned with high impact scrubbing action.

* * * * *